US008622385B2

(12) United States Patent
Ueyama et al.

(10) Patent No.: US 8,622,385 B2
(45) Date of Patent: Jan. 7, 2014

(54) MEDIUM RECEIVING DEVICE AND RECORDING DEVICE

(71) Applicant: Seiko Epson Corporation, Tokyo (JP)

(72) Inventors: Naohiro Ueyama, Matsumoto (JP); Hideo Mikuriya, Suwa (JP); Masahiro Ogihara, Okaya (JP); Ryota Takenaka, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/781,147

(22) Filed: Feb. 28, 2013

(65) Prior Publication Data

US 2013/0277908 A1 Oct. 24, 2013

(30) Foreign Application Priority Data

Apr. 18, 2012 (JP) ..... 2012-094927

(51) Int. Cl.
*B65H 31/00* (2006.01)

(52) U.S. Cl.
USPC ..... 271/207

(58) Field of Classification Search
USPC ..... 271/207, 209, 213, 223; 347/104, 262, 347/264; 400/647.1, 625; 399/384
See application file for complete search history.

(56) References Cited

U.S. PATENT DOCUMENTS

| | | | | |
|---|---|---|---|---|
| 6,568,865 | B1 | 5/2003 | Fujioka et al. | |
| 7,997,578 | B2 * | 8/2011 | Saito et al. | 271/213 |
| 2003/0146565 | A1 | 8/2003 | Fujioka | |
| 2010/0111584 | A1 * | 5/2010 | Shiohara et al. | 399/405 |
| 2011/0024975 | A1 * | 2/2011 | Saito et al. | 271/207 |

FOREIGN PATENT DOCUMENTS

| | | | |
|---|---|---|---|
| JP | 2000-038247 | A | 2/2000 |
| JP | 2000-071535 | A | 3/2000 |
| JP | 2000-219393 | A | 8/2000 |
| JP | 2000-219394 | A | 8/2000 |
| JP | 2001-130814 | A | 5/2001 |
| JP | 2002-308508 | A | 10/2002 |
| JP | 2003-212415 | A | 7/2003 |
| JP | 2003-276921 | A | 10/2003 |
| JP | 2007-145459 | A | 6/2007 |
| JP | 2008-094575 | A | 4/2008 |
| JP | 2009-242111 | A | 10/2009 |
| JP | 2010-215367 | A | 9/2010 |
| JP | 2011-057453 | A | 3/2011 |

* cited by examiner

*Primary Examiner* — Thomas Morrison
(74) *Attorney, Agent, or Firm* — Nutter McClennen & Fish LLP; John J. Penny, Jr.; Michael P. Visconti, III

(57) ABSTRACT

A medium receiving device includes a support shaft that extends in a width direction of the sheet that intersects with an ejection direction of the sheet at a position spaced from the apparatus body, a locking member that is fixedly provided at a position which is lower than the apparatus body in the gravity direction and on the side of the apparatus body with respect to the support shaft and extends in the width direction of the sheet, and a medium holding member that is hung between the support shaft and the locking member so as to form a receiving surface for the sheet which falls thereon and is capable of holding the sheet on the receiving surface, wherein the support shaft moves between a first position and a second position with rotative displacement about a rotation shaft that extends in the width direction of the sheet.

6 Claims, 8 Drawing Sheets

MEDIUM RECEIVING DEVICE AND RECORDING DEVICE

BACKGROUND

1. Technical Field

The present invention relates to a medium receiving device that receives media which have been ejected and fallen into the medium receiving device at a lower position in the gravity direction and a recording device having the medium receiving device.

2. Related Art

Ink jet printers are known as an example of recording device that performs recording on a medium. JP-A-2010-215367 and JP-A-2001-130814 disclose a configuration of a printer in which recording is performed by ejecting ink from a recording head in a recording unit onto a long sheet-shaped medium which is unwound from a roll of the medium and is transported through the recording unit, and then the medium is cut at a predetermined length and is ejected from the printer.

That is, the printer described in JP-A-2010-215367 includes a recording unit that performs recording on a sheet (medium), and a sheet storing unit (medium receiving device) that receives and stores the sheets which have been ejected from a paper ejection guide disposed at a position downstream to the recording unit and fallen in an obliquely forward direction such that the sheet storing unit receives and stores the sheets at a position lower than the paper ejection guide. The sheet storing unit of this printer is movable between a receiving position in which a rod-shaped member that forms a receiving port for the sheets ejected from the recording unit between the rod-shaped member and the distal end of the paper ejection guide is positioned in front of the paper ejection guide, and a storing position in which the rod-shaped member is positioned at the back of the receiving position and is housed under the paper ejection guide without forming the receiving port.

In the printer described in JP-A-2010-215367, the rod-shaped member that serves as the front edge of the receiving port in the sheet storing unit is configured to be movable backward from the receiving position, but not movable forward from the receiving position. As a result, the receiving port that is formed between the rod-shaped member and the distal end of the paper ejection guide cannot be enlarged forward, which causes a problem that the sheets stored in the sheet storing unit are difficult to be picked-up from the front side through the receiving port.

Further, in an ejected paper receiving device (medium receiving device) of the printer described in JP-A-2001-130814, a front-side connection member that forms a receiving port for print papers (media) ejected from a printing unit between the front-side connection member and the distal end of the paper ejection section is movable between a front-side ejected paper receiving position which provides relatively large receiving port between the front-side connection member and the distal end of the paper ejection section, and a back-side ejected paper receiving position which provides relatively small receiving port. Accordingly, in this printer, since the front-side connection member of the ejected paper receiving device is movable from the back-side ejected paper receiving position to the front-side ejected paper receiving position, the receiving port can be enlarged forward, which allows the print sheets to be easily picked-up from the front side through the receiving port.

However, in the printer described in JP-A-2001-130814, when the front-side connection member of the ejected paper receiving device is displaced from the back-side ejected paper receiving position to the front-side ejected paper receiving position, the entire ejected paper receiving device rotates forward to a large extent about the pivot axis on the proximal end thereof, which is opposite from the distal end that forms the receiving port. That is, in the ejected paper receiving device in which a sheet member formed of a fabric material is hung between the front-side connection member and a back-side connection member with a sag, the back-side connection member is displaced forward simultaneously with the front-side connection member. As a result, when the entire ejected paper receiving device rotates forward to a large extent about the pivot axis on the proximal end thereof, the print sheets stored in the ejected paper receiving device are biased forward due to an inertial force, thereby causing a problem that the print sheets may extend out of the ejected paper receiving device.

Such a problem is not limited to the above-mentioned ink jet printer and the ejected paper receiving device in the printer, but is generally common to medium receiving devices that receive media that have been ejected and fallen from a medium ejection unit such that the media are received at a position lower than the medium ejection unit in the gravity direction and recording devices having the medium receiving device.

SUMMARY

An advantage of some aspects of the invention is that a medium receiving device that facilitates picking-up of a medium while preventing the medium from extending out of the medium receiving device during picking-up and a recording device having the medium receiving device are provided.

According to an aspect of the invention, a medium receiving device that receives a medium which is ejected and falls from a medium ejection unit at a position lower than the medium ejection unit in the gravity direction includes a first member that extends in a width direction of the medium that intersects with an ejection direction of the medium at a position spaced from the medium ejection unit, a second member that is fixedly provided at a position which is lower than the medium ejection unit in the gravity direction and on the side of the medium ejection unit with respect to the first member and extends in the width direction of the medium, and a medium holding member that is hung between the first member and the second member so as to form a receiving surface for the medium which falls thereon and is capable of holding the medium on the receiving surface, wherein the first member moves between a first position which is spaced from the medium ejection unit in a direction that intersects with the vertical line and a second position which is further spaced from the medium ejection unit than the first position with rotative displacement about a rotation shaft that extends in the width direction of the medium.

With this configuration, the medium which has been ejected and fallen from the medium ejection unit is received on the receiving surface of the medium holding member in the medium receiving device and held on the receiving surface. When the medium held on the receiving surface is picked-up from the medium receiving device, the first member is rotatively displaced from the first position to the second position. Accordingly, the first member is further spaced from the medium ejection unit, thereby increasing the size of the receiving port for the medium in the medium receiving device that is formed between the first member and the medium ejection unit. As a result, the media can be easily picked-up from the medium receiving device through the wide receiving port. Further, the medium holding member that forms the receiving surface for the medium is hung between the first member and the second member, and accordingly, even if the first member is rotatively displaced to widen the receiving port, the entire receiving surface of the medium holding member is prevented from being reversed since the second member is provided at a fixed position. As a result, it is possible to prevent the medium from extending out of the medium holding member during picking-up of the medium.

In the medium receiving device according to the above-mentioned aspect of the invention, a distance between the rotation shaft and the first member in a direction that intersects with an axial direction of the rotation shaft is smaller than a distance between the rotation shaft and the second member in the direction that intersects with the axial direction of the rotation shaft.

With this configuration, the displacement amount of the first member about the rotation shaft when the first member is rotatively displaced about the rotation shaft can be smaller compared with the case where the distance between the rotation shaft and the first member is larger than the distance between the rotation shaft and the second member. As a result, the displacement amount of the distance between the first member and the second member when the first member is rotatively displaced from the first position to the second position decreases, thereby reducing a risk of the medium holding member that is hung between the first member and the second member interfering with rotative displacement of the first member. This allows the first member to be easily rotatable with the medium holding member being hung between the first member and the second member during picking-up of the medium.

In the medium receiving device according to the above-mentioned aspect of the invention, the rotation shaft is located vertically above a straight line extending between the first member and the second member in the direction that intersects with the axial direction of the rotation shaft.

With this configuration, when the first member is rotatively displaced downward from the first position to the second position during picking-up of the medium, the distance between the first member and the second member decreases. As a result, the position of the first member can be rotatable without effecting on the tension of the medium holding member that is hung between the first member and the second member.

The medium receiving device according to the above-mentioned aspect of the invention further includes a support member that is configured to be rotatable about the rotation shaft while supporting the first member and has an engaging projection that extends in the axial direction of the rotation shaft from a position spaced from the rotation shaft in the direction that intersects with the axial direction of the rotation shaft, a member to be slid having a section to be slid on which the engaging projection slides when the support member rotates, and a bias member that biases the support member in the direction that intersects with the axial direction of the rotation shaft so that the engaging projection is brought into pressing contact with the section to be slid, wherein the section to be slid has a cam surface that locks the engaging projection in a circumferential direction about the rotation shaft due to a biasing force of the bias member.

With this configuration, when the cam surface of the section to be slid is brought into pressing contact with the engaging projection due to the biasing force of the bias member, the engaging projection is locked by the cam surface in the circumferential direction about the rotation shaft. As a result, the rotation position of the support member about the rotation shaft can be stably held. Further, when the first member rotates about the rotation shaft, the engaging projection resists the biasing force of the bias member and moves over the cam surface, thereby releasing engagement between the cam surface and the engaging projection. As a result, rotation movement of the support member about the rotation shaft becomes possible, thereby allowing the first member to be displaced as necessary during picking-up of the medium.

In the medium receiving device according to the above-mentioned aspect of the invention, the section to be slid composed of a first section to be slid that extends in the circumferential direction about the rotation shaft and a second section to be slid that extends downward from a lower end of the first section to be slid on the radially outside of the rotation shaft.

When the number of the media that are held in the medium holding member increases, the size of the receiving port for the media that is formed between the medium ejection unit and the first member gradually decreases. According to the above configuration, when the weight of the media increases as the number of the media held in the medium holding member increases, the engaging projection of the support member that supports the first member slides downward on the second section to be slid of the member to be slid. As a result, as the support member rotates downward about the rotation shaft, the size of the receiving port for the media that is formed between the medium ejection unit and the first member increases. Accordingly, even if a plurality of media are held in the medium holding member, a sufficient size of the receiving port for the media can be achieved between the medium ejection unit and the first member.

According to another aspect of the invention, a recording device includes a recording unit that performs recording on a medium, and medium receiving device of the above-mentioned configuration that receives the medium on which recording has been performed by the recording unit. With this configuration, a similar effect to that of the invention of the medium receiving device can be obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
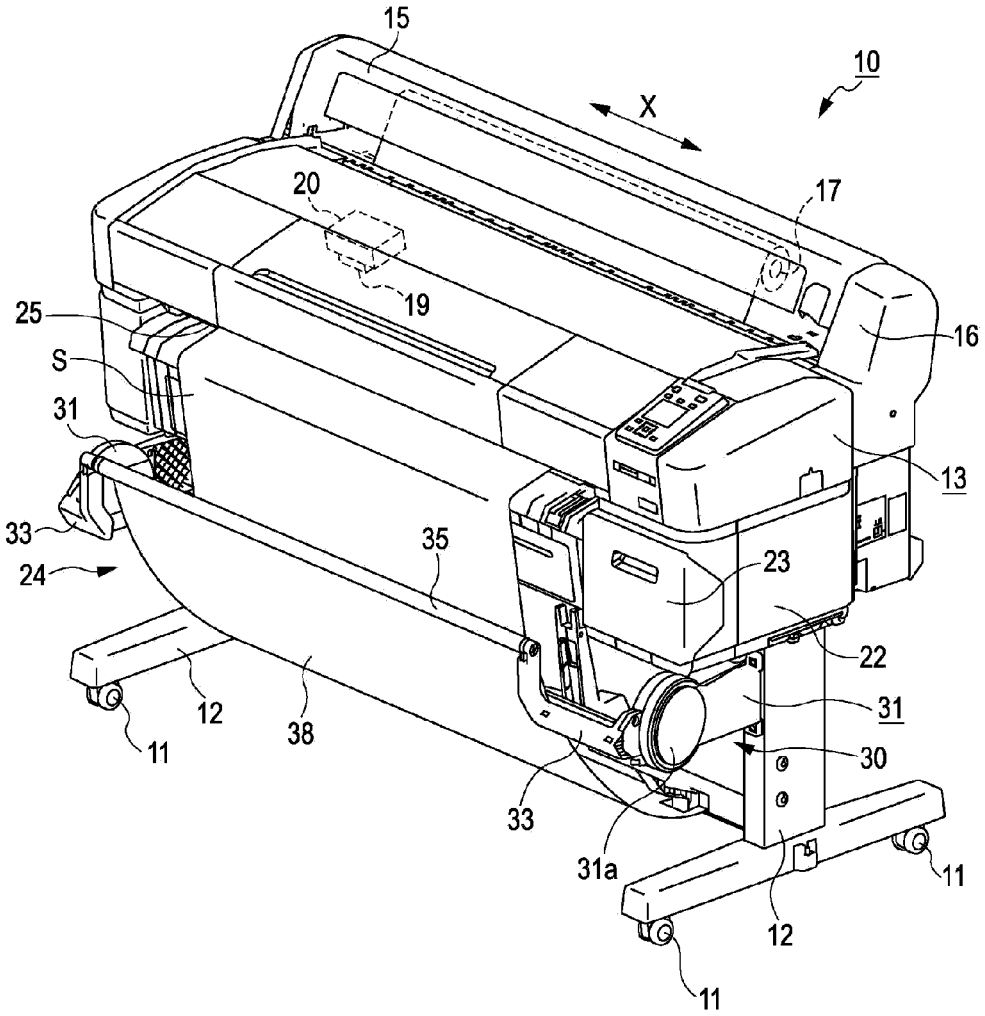
FIG. 1 is a perspective view of a recording device according to an embodiment of the invention.

One embodiment of the invention will be described below with reference to FIGS. 1 to 7B. As shown in FIG. 1, a recording device 10 includes a pair of legs 12, each of which having an inverted T-shape in side view, a pair of caster wheels 11 that are capable of running on a floor surface and are mounted on the lower end of the respective legs 12, and an apparatus body 13 that is placed on and assembled to the pair of legs 12.

The apparatus body 13 is formed in a substantially cuboid shape that extends in a width direction of a sheet S which is an example of a medium and a sheet feeding unit 16 that extends obliquely upward from the back side of the apparatus body 13 and supports a roll sheet holder 15.

A roll of sheet paper S is rotatably held by a rotation shaft 17 in the roll sheet holder 15. When the rotation shaft 17 rotates by driving a feed motor, which is not shown in the figure, the sheet S unwound from the roll is fed into the apparatus body 13.

A carriage 20 is disposed in the apparatus body 13 so as to reciprocate in a main scan direction X. A recording head 19 which is an example of a recording unit is mounted on the carriage 20. In the apparatus body 13, a plurality of pairs of transportation rollers (not shown in the figure) that are driven by a transportation motor, which is not shown in the figure, to transport the sheet S fed out from the sheet feeding unit 16. The recording device 10 performs recording of an image according to print data on the sheet S by substantially alternatively repeating a recording operation for one scan in which ink droplets are ejected from the recording head 19 while the carriage 20 moves in the main scan direction X and a transportation operation in which the sheet S is transported to the next recording position.

Further, a cartridge container 22 having a front opening that contains a plurality of ink cartridges 21 (see FIG. 2) and a cover 23 that openably covers the front opening of the cartridge container 22 are provided on the front side of the apparatus body 13 at one end in the longitudinal direction of the apparatus body 13 (the right end in FIG. 1). The cover 23 rotates in the forward and backward direction about a rotation shaft (not shown in the figure) that extends in the longitudinal direction of the apparatus body 13 at a lower end of the cover 23, thereby uncovering the opening of the cartridge container 22. When the recording head 19 ejects ink from the ink cartridges 21 of the cartridge container 22, printing is performed on the sheet S.

Further, a rotation cutter (not shown in the figure) is provided in the apparatus body 13 at a position downstream with respect to the recording head 19 in the transportation direction of the sheet S so as to move in the width direction of the sheet S. The rotation cutter separates the sheet S into pieces of a predetermined length by cutting the sheet S in the thickness direction while moving in the width direction of the sheet S.

A medium receiving unit 24 as an example of a medium receiving device that receives the sheets S after printing is performed is disposed on the lower side of the apparatus body 13. The medium receiving unit 24 receives the sheets S which have been ejected and fallen from an ejection port 25 that is open to the front side of the apparatus body 13 which is an example of a medium ejection unit such that the sheets S are received at a position lower than the apparatus body 13 in the gravity direction.

Figure 2:
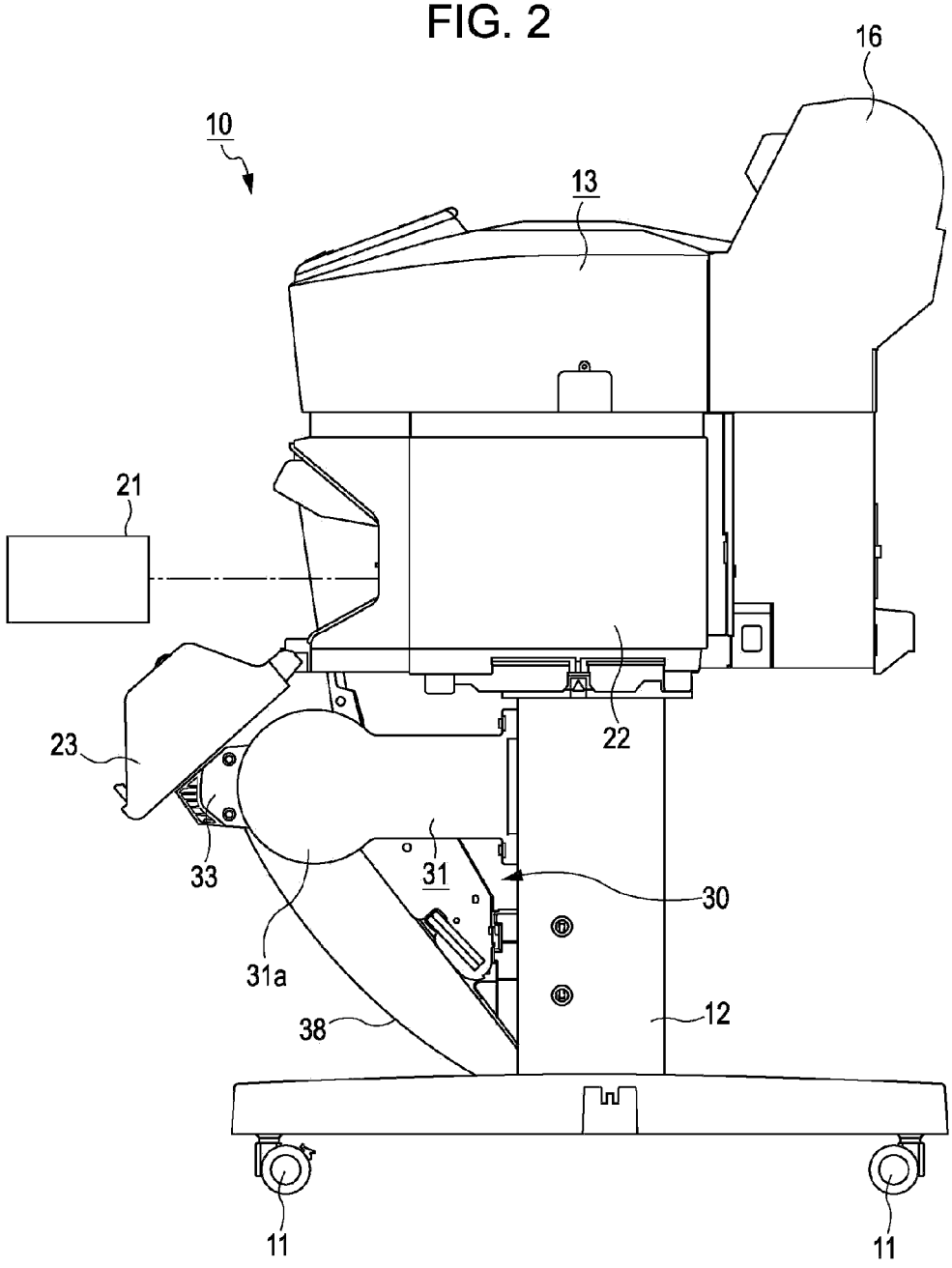
FIG. 2 is a side view of the recording device according to the embodiment.

Next, a configuration of the medium receiving unit 24 will be described. As shown in FIGS. 1 and 2, rotative arm mechanisms 30 are disposed at the upper position of each of the pair of legs 12. Each rotative arm mechanism 30 includes a base 31 that extends horizontally forward from the leg 12 and an arm 33 that is connected to the base 31 so as to be rotatable about a rotation shaft 32 (see FIG. 5) that extends in the width direction of the sheet S.

One of a pair of arms 33 which is positioned adjacent to the cartridge container 22 extends horizontally forward from a position connected to the base 31, and then bends at a substantially right angle in the horizontal direction toward the inside of the width direction of the sheet S, and then bends vertically upward at a substantially right angle. That is, a portion of the arm 33 which corresponds to the cartridge container 22 in the width direction of the sheet S has a substantially L-shape in front view.

Accordingly, as shown in FIG. 2, a portion of the arm 33 that bends in a substantially L-shape is located at a position offset from a rotation path of the cover 23 rotating forward in the direction by which the opening of the cartridge container 22 is opened. As a result, an opening movement of the cover 23 is not interfered by the arm 33.

The other of the pair of arms 33 extends horizontally forward from a position connected to the base 31, and then bends vertically upward at a substantially right angle. Further, a support shaft 35 which is an example of a first member horizontally extends in the width direction of the sheet S between each of the distal ends of the pair of arms 33. Accordingly, the arms 33 serve as support members that are rotatable about the rotation shaft 32 while supporting the support shaft 35.

Figure 3:
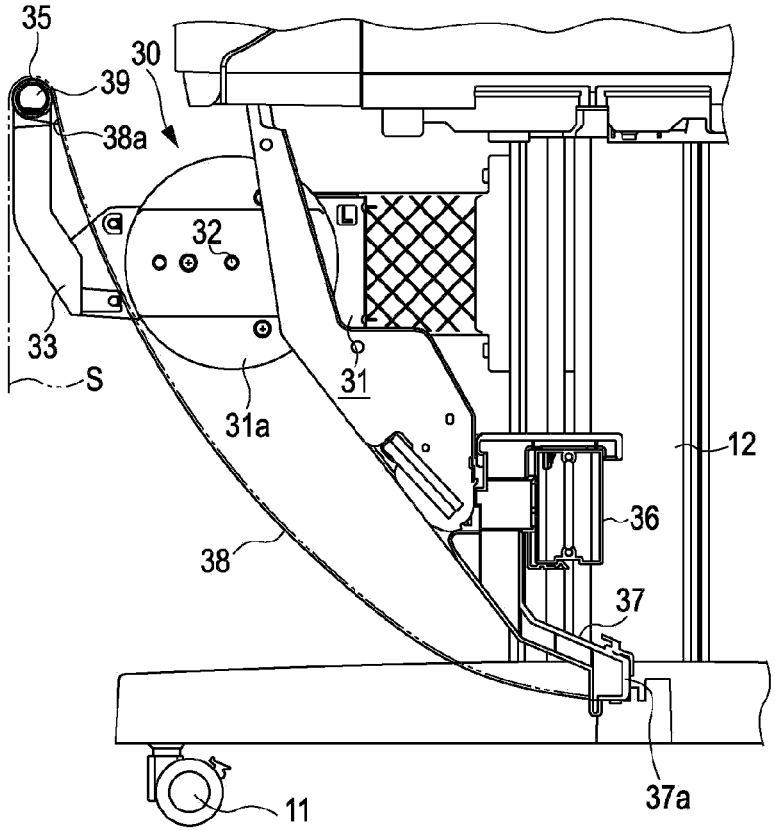
FIG. 3 is a sectional view of the recording device according to the embodiment.

As shown in FIG. 3, a post 36 extends between each of the pair of legs 12 in the width direction of the sheet S. The post 36 supports a locking member 37 as an example of a second member that extends in the width direction of the sheet S at a fixed position. The locking member 37 extends straight obliquely downward toward the back side of the apparatus body 13 from a position connected to the post 36. The locking member 37 has a locking portion 37*a* on the distal end thereof that bends vertically downward at an obtuse angle.

Further, a medium holding member 38 formed of a sheet material such as a fabric is hung between the support shaft 35 and the locking portion 37*a* of the locking member 37. Specifically, since a hollow cylinder 38*a* is formed at the front edge of the medium holding member 38, the medium holding member 38 is hung over the support shaft 35 by inserting the support shaft 35 into the hollow cylinder 38*a*. The support shaft 35 and the locking portion 37*a* of the locking member 37 are spaced from each other by a predetermined distance such that the medium holding member 38 sags therebetween. Accordingly, the medium holding member 38 forms a curved surface with the upper surface being concave such that the upper surface serves as a receiving surface of the sheets S that have been ejected and fallen from the ejection port 25 of the apparatus body 13. The leading edge of the sheet S comes into contact with the upper surface of the medium holding member 38, and then moves along the upper surface of the medium holding member 38 until it abuts and is locked by the locking portion 37*a* of the locking member 37.

In this embodiment, since the rotative arm mechanism 30 is connected to the upper portion of the leg 12, the length of the base 31 is relatively small compared with the case where the rotative arm mechanism 30 is connected to the lower end of the leg 12, which improves strength of the base 31. Further, the rotational diameter of the support shaft 35 about the rotation shaft 32 is relatively small compared with the case where the rotative arm mechanism 30 is connected to the lower end of the leg 12. As a result, the distance between the rotation shaft 32 and the support shaft 35 in the direction that intersects with the axial direction of the rotation shaft 32 is smaller than the distance between the rotation shaft 32 and the locking portion 37*a* of the locking member 37 in the direction that intersects with the axial direction of the rotation shaft 32. Further, in this embodiment, the rotation shaft 32 is located vertically above the straight line extending between the support shaft 35 and the locking portion 37*a* of the locking member 37 in the direction that intersects with the axial direction of the rotation shaft 32.

Figure 4:
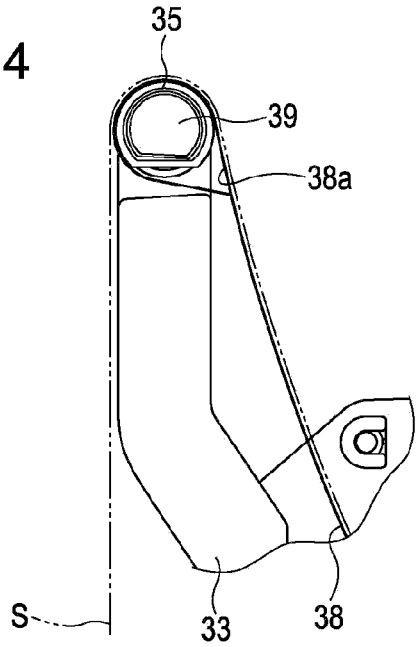
FIG. 4 is an enlarged view of an essential part of FIG. 3.

In this embodiment, as shown in FIG. 4, the support shaft 35 has a substantially D-shaped hollow cross section. A projection 39 having a substantially D-shaped cross section is formed at each distal end of the pair of arms 33 so as to extend toward the inside of the width direction of the sheet S. Each end of the support shaft 35 in the axial direction fits on the periphery of the projection 39 in a non-rotatable manner. Further, the outer diameter of the support shaft 35 is about 30 mm, which is suitable to be held by a user.

Figure 5:
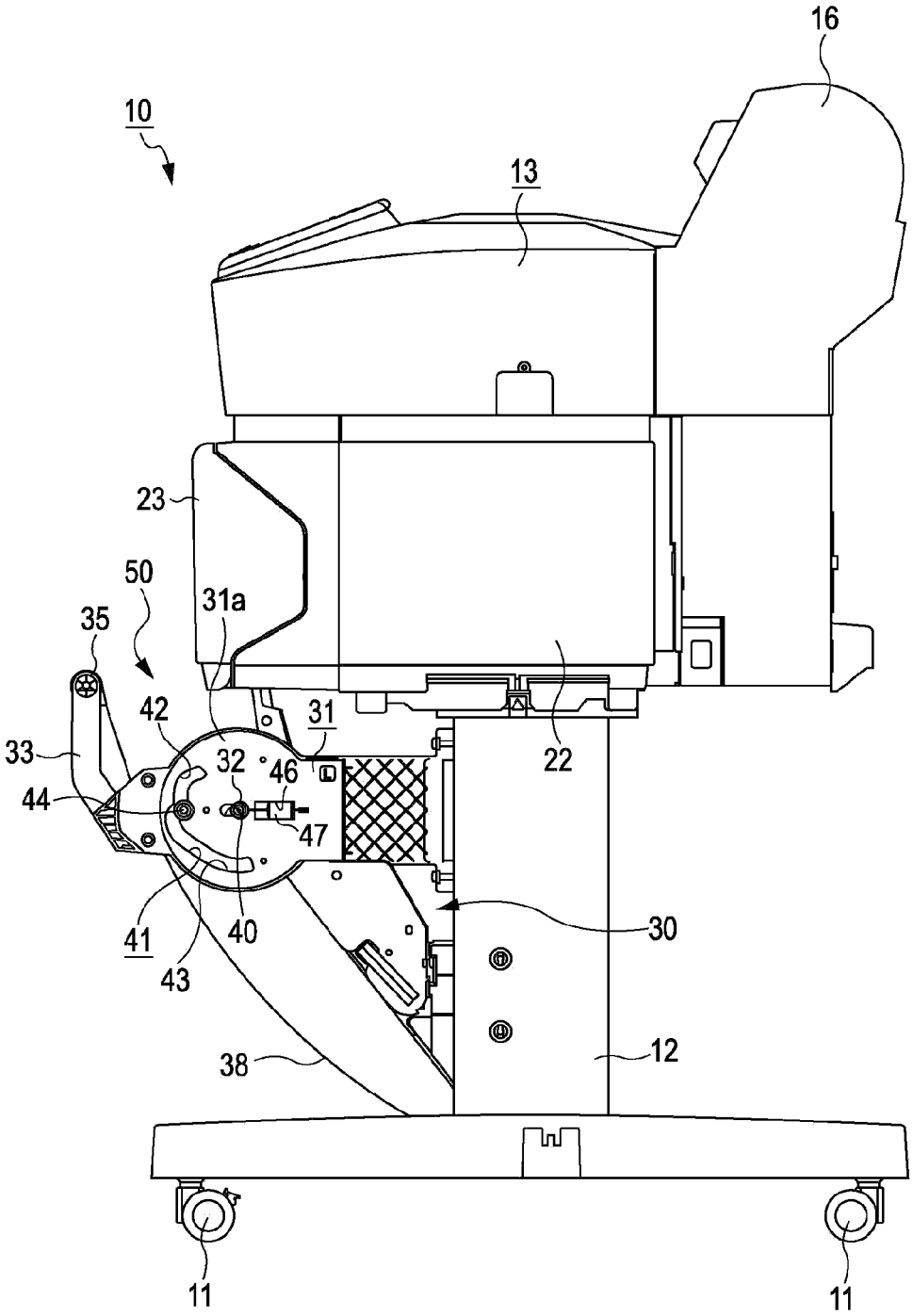
FIG. 5 is a side view of the recording device without showing a portion of an exterior of a rotative arm mechanism.

Next, a connection structure between the base 31 and the arm 33 in the rotative arm mechanism 30 will be described. As shown in FIG. 5, in which a portion of an exterior of the base 31 of the rotative arm mechanism 30 is not shown, the proximal end portion of the base 31 is connected to the leg 12, while the distal end portion 31*a* is formed in a substantially disk shape. An oblong hole 40 elongated in the front-back direction is formed at the substantially center on the side face of the distal end portion 31*a* of the base 31 so as to penetrate in the thickness direction of the base 31. The rotation shaft 32 that extends from the arm 33 toward the outside of the width direction of the sheet S fits into the oblong hole 40 so as to be movable in the front-back direction. That is, the arm 33 is relatively movable with respect to the base 31 in the front-back direction that intersects with the axial direction of the rotation shaft 32.

Further, a groove 41 is formed at a position in front of the oblong hole 40 on the distal end portion 31*a* of the base 31 so as to penetrate in the thickness direction of the base 31. The groove 41 is composed of a first groove 42 and a second groove 43. The first groove 42 has a lower end at a position in front of the oblong hole 40 at the substantially same height as the oblong hole 40 and extends upward in the substantially circumferential direction about the oblong hole 40, while the second groove 43 has an upper end at a position same as that of the lower end of the first groove 42 and extends downward in the substantially circumferential direction about the oblong hole 40.

Specifically, as the first groove 42 extends upward from the lower end to a halfway point, the distance between the first groove 42 and the oblong hole 40 gradually increases, and as the first groove 42 extends upward from the halfway point to the upper end, the distance between the first groove 42 and the oblong hole 40 gradually decreases. Further, as the second groove 43 extends downward from the upper end to a halfway point, the distance between the second groove 43 and the oblong hole 40 gradually increases, and as second groove 43 extends downward from the halfway point to the lower end, the distance between the second groove 43 and the oblong hole 40 gradually decreases.

A cylindrical engaging projection 44 is formed on the arm 33 at a position spaced from the rotation shaft 32 in the radial direction of the rotation shaft 32 so as to extend toward the outside of the width direction of the sheet S and engages the groove 41 of the base 31. As the arm 33 rotates about the rotation shaft 32 and is displaced in the circumferential direction about the rotation shaft 32, the engaging projection 44 slides on the groove 41 of the base 31. Accordingly, in this embodiment, the groove 41 on which the engaging projection 44 slides serves as a section to be slid, and the base 31 having the groove 41 also serves as a member to be slid.

Further, the inner surface of the second groove 43 that extends obliquely forward and downward from the upper end to the halfway point while gradually increasing the distance from the oblong hole 40 serves as a cam surface 45 (see for example, FIG. 6A) that locks the engaging projection 44 in the circumferential direction about the rotation shaft 32. The cam surface 45 extends straight obliquely downward toward the outside in the radial direction of the rotation shaft 32. In this embodiment, the first groove 42 extending in the circumferential direction about the rotation shaft 32 serves as a first section to be slid, while the second groove 43 extending downward from the lower end of the first groove 42 toward the outside in the radial direction of the rotation shaft 32 serves as a second section to be slid.

Further, a recess 46 is formed at a position at the back of the oblong hole 40 on the distal end portion 31*a* of the base 31 at the substantially same height as the oblong hole 40. A tension spring 47 which is an example of a bias member is disposed between the inner surface of the recess 46 and the rotation shaft 32 of the arm 33. The tension spring 47 biases the rotation shaft 32 of the arm 33 to the back in the horizontal direction, thereby pressing the engaging projection 44 of the arm 33 against the inner surface of the groove 41.

Next, an operation of the above-mentioned recording device 10 will be described below, specifically focusing on an operation of the arm 33 of the rotative arm mechanism 30 rotating about the rotation shaft 32 while supporting the support shaft 35.

As shown in FIG. 5, when the medium receiving unit 24 receives the sheet S ejected from the ejection port 25 of the apparatus body 13, engaging projections 44 of the arms 33 in the rotative arm mechanism 30 are locked by the cam surface 45 of the groove 41 in the circumferential direction about the rotation shaft 32. Then, the rotation position of the arms 33 about the rotation shaft 32 are held such that the distal ends of the arms 33 extend vertically upward. In this configuration, the support shaft 35 supported between the distal ends of the arms 33 is located at a position spaced forward from the lower end face of the apparatus body 13 and at the substantially same height as the lower end face of the apparatus body 13. A space between the support shaft 35 and the lower end face of the apparatus body 13 serves as a receiving port 50 for the sheet S ejected from the ejection port 25 of the apparatus body 13. That is, a position of the support shaft 35 shown in FIG. 5 is a receiving position of the sheet S ejected from the ejection port 25 of the apparatus body 13.

Figure 6B:
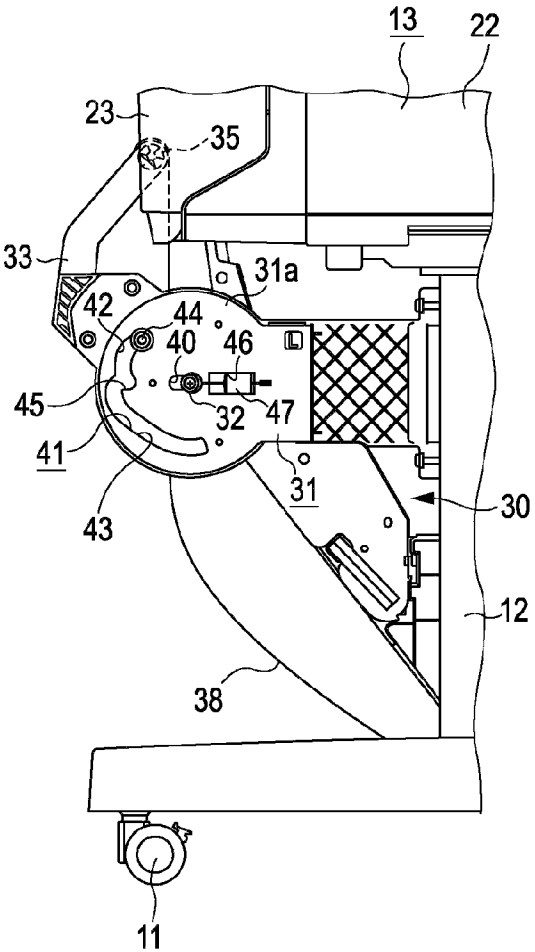
FIG. 6B is a side view of the rotative arm mechanism during operation to rotate the support shaft from the receiving position to the storing position, showing that the support shaft has been rotated to the storing position.
Figure 6A:
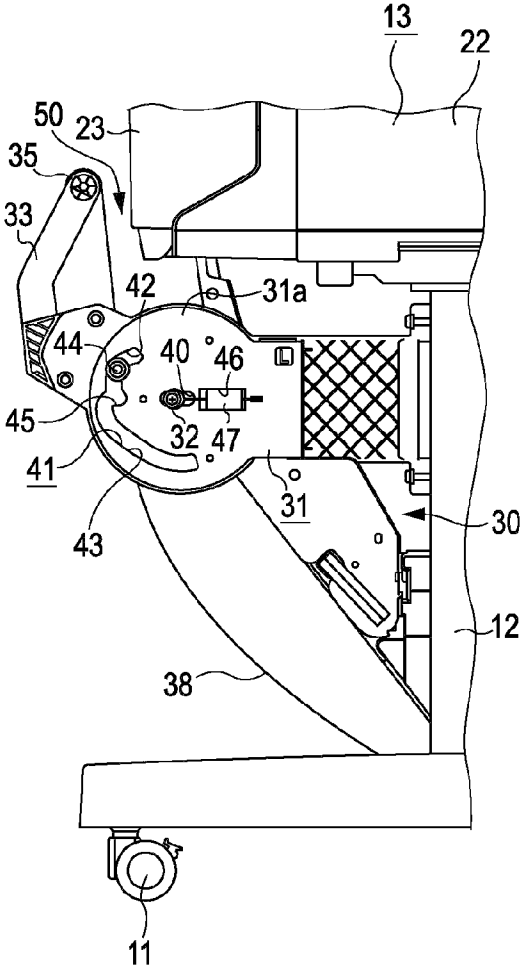
FIG. 6A is a side view of a rotative arm mechanism during operation to rotate a support shaft from a receiving position to a storing position, showing that the support shaft is rotating toward a storing position.

FIG. 6A shows that the support shaft 35 has been lifted up from the receiving position. When the arm 33 rotates upward about the rotation shaft 32, the engaging projection 44 slides upward on the inner surface of the first groove 42 while being biased by the tension spring 47. The first groove 42 extends upward from the lower end to a halfway point with the distance between the first groove 42 and the oblong hole 40 gradually increasing. Accordingly, as the engaging projection 44 slides upward, the rotation shaft 32 resists the biasing force of the tension spring 47 and moves horizontally forward in the oblong hole 40 toward the side of the engaging projection 44. That is, when the engaging projection 44 is lifted upward from the lower end of the first groove 42, it is necessary to apply an external force that resists the biasing force of the tension spring 47. At this point, the engaging projection 44 is held at the lower end of the first groove 42 due to the biasing force of the tension spring 47. As a result, the rotation position of the arm 33 about the rotation shaft 32 is stably held such that the support shaft 35 is positioned at the receiving position.

When the engaging projection 44 has passed by a portion of the first groove 42 that extends upward with the distance between the first groove 42 and the oblong hole 40 gradually increases, the engaging projection 44 enters a portion of the first groove 42 in which the distance between the first groove 42 and the oblong hole 40 gradually decreases. As the engaging projection 44 slides upward in the first groove 42, the rotation shaft 32 moves horizontally backward in the oblong hole 40 toward the side opposite from the engaging projection 44 due to the biasing force of the tension spring 47.

FIG. 6B shows that the engaging projection 44 has moved to the upper end of the first groove 42 with the aid of the biasing force of the tension spring 47. At this point, the support shaft 35 supported between the distal ends of the arms 33 is located at a position closer to the apparatus body 13 in the front-back direction compared with the case where the support shaft 35 is positioned at the receiving position. As a result, a distance from the apparatus body 13 to the arm 33 of the rotative arm mechanism 30 positioned in front of the apparatus body 13 in the storing position is smaller than that in the receiving position. Accordingly, it is possible to reduce the size of the recording device 10 in the horizontal direction when the support shaft 35 is not in use.

Further, when the support shaft 35 is pressed downward so as to move the engaging projection 44 downward from the upper end of the first groove 42, it is necessary to apply an external force that resists the biasing force of the tension spring 47. At this point, the engaging projection 44 is held at the upper end of the first groove 42 due to the biasing force of the tension spring 47. As a result, the rotation position of the arm 33 about the rotation shaft 32 is stably held such that the support shaft 35 is positioned at the storing position.

Figure 7B:
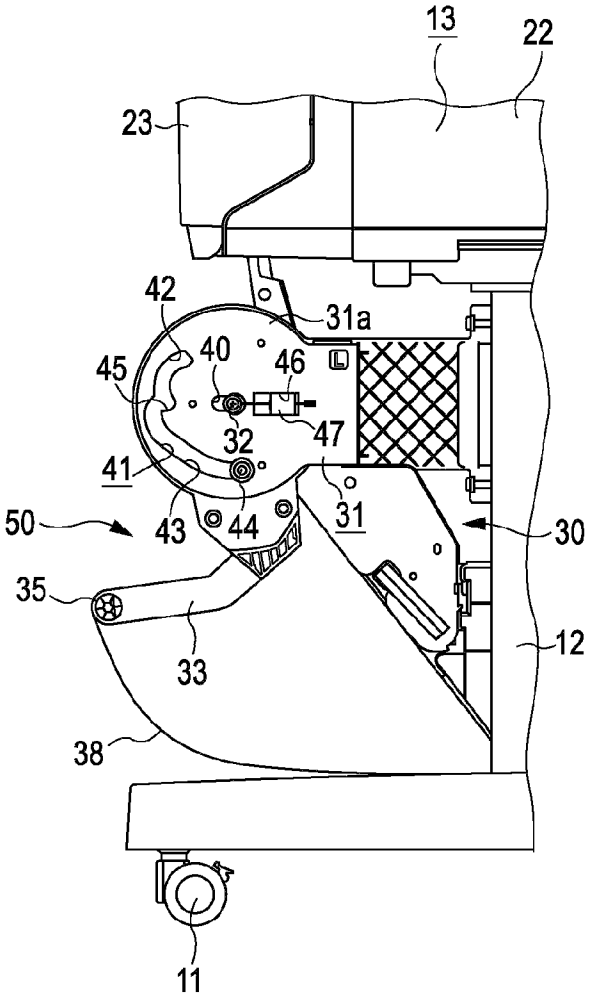
FIG. 7B is a side view of the rotative arm mechanism during operation to rotate the support shaft from the receiving position to the picking-up position, showing that the support shaft has been rotated to the picking-up position.
Figure 7A:
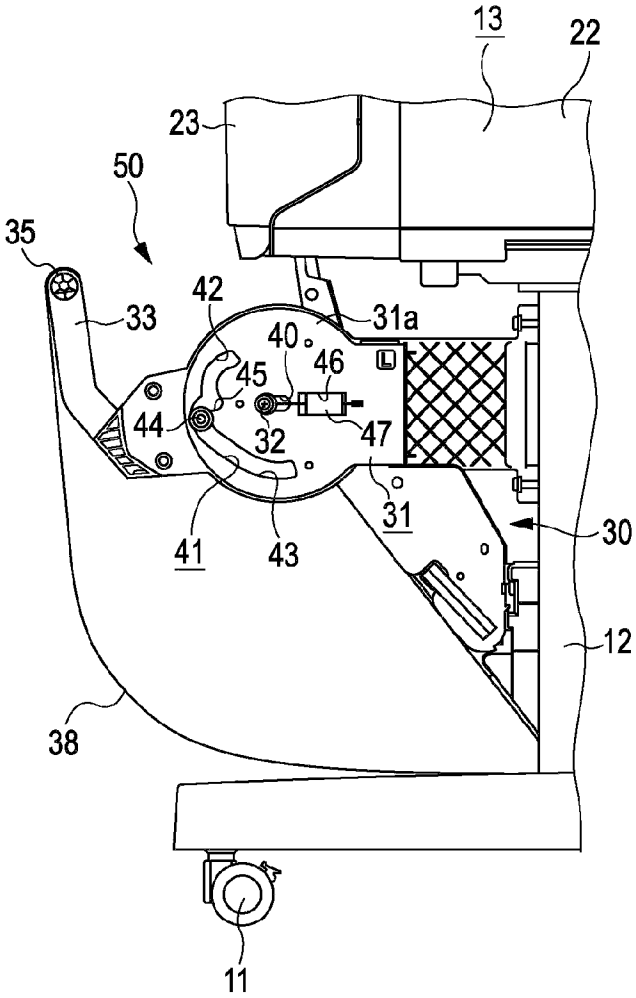
FIG. 7A is a side view of the rotative arm mechanism during operation to rotate the support shaft from the receiving position to a picking-up position, showing that the support shaft is rotating toward the picking-up position.

FIG. 7A shows that the support shaft 35 has been pressed downward from the receiving position. When the arm 33 rotates downward about the rotation shaft 32, the engaging projection 44 slides downward on the cam surface 45 that extends from the upper end of the second groove 43 while being biased by the tension spring 47. The cam surface 45 extends downward from the upper end of the second groove 43 toward the outside in the radial direction of the rotation shaft 32 with the distance between the second groove 43 and the oblong hole 40 gradually increasing. Accordingly, as the engaging projection 44 slides downward, the rotation shaft 32 resists the biasing force of the tension spring 47 and moves horizontally forward in the oblong hole 40 toward the side of the engaging projection 44. That is, when the support shaft 35 is pressed downward so as to move the engaging projection 44 downward from the upper end of the second groove 43, it is necessary to apply an external force that resists the biasing force of the tension spring 47. At this point, the engaging projection 44 is held at the upper end of the second groove 43 due to the biasing force of the tension spring 47. As a result, the rotation position of the arm 33 about the rotation shaft 32 is stably held such that the support shaft 35 is positioned at the receiving position.

When the engaging projection 44 has passed by the cam surface 45 which is a portion of the second groove 43 that extends downward with the distance between the second groove 43 and the oblong hole 40 gradually increases, the engaging projection 44 enters a portion of the second groove 43 in which the distance between the second groove 43 and the oblong hole 40 gradually decreases. As the engaging projection 44 slides downward in the second groove 43, the rotation shaft 32 moves horizontally backward in the oblong hole 40 toward the side opposite from the engaging projection 44 due to the biasing force of the tension spring 47.

FIG. 7B shows that the engaging projection 44 has moved to the lower end of the second groove 43 with the aid of the biasing force of the tension spring 47. At this point, the support shaft 35 supported between the distal ends of the arms 33 is located at the picking-up position which is largely spaced from the apparatus body 13 in the front-back direction compared with the case where the support shaft 35 is positioned at the receiving position. Since the receiving port 50 for the sheet S that is formed between the support shaft 35 and the lower end face of the apparatus body 13 becomes large, the sheets S are easily picked-up from the medium receiving unit 24 through the wide receiving port 50. That is, in this embodiment, the receiving position at which the sheet S ejected from the ejection port 25 of the apparatus body 13 is received corresponds to a first position, while the picking-up position which is largely spaced from the apparatus body 13 compared with the receiving position corresponds to a second position. The support shaft 35 moves between the receiving position and the picking-up position with rotative displacement about rotation shaft 32.

Further, when the support shaft 35 is lifted upward so as to move the engaging projection 44 upward from the lower end of the second groove 43, it is necessary to apply an external force that resists the biasing force of the tension spring 47. At this point, the engaging projection 44 is held at the lower end of the second groove 43 due to the biasing force of the tension spring 47. As a result, the rotation position of the arm 33 about the rotation shaft 32 is stably held such that the support shaft 35 is positioned at the picking-up position.

In this embodiment in which the medium holding member 38 that forms a receiving surface of the sheet S is hung between the support shaft 35 and the locking member 37, the support shaft 35 that supports the proximal end portion of the sheet S in the ejection direction from the underside is rotatively displaced about the rotation shaft 32, while the locking member 37 that locks the leading edge of the sheet S in the ejection direction is provided at a fixed position. Accordingly, even if the support shaft 35 is rotatively displaced about the rotation shaft 32 to widen the receiving port 50 for the sheet S, the entire receiving surface of the medium holding member 38 is prevented from being reversed. As a result, it is possible to prevent the sheet S from extending out of the medium holding member 38 during picking-up of the sheet S.

Moreover, in this embodiment, a distance between the rotation shaft 32 and the support shaft 35 in the direction that intersects with the axial direction of the rotation shaft 32 is smaller than the distance between the rotation shaft 32 and the locking portion 37*a* of the locking member 37 in the direction that intersects with the axial direction of the rotation shaft 32. Accordingly, the displacement amount of the support shaft 35 about the rotation shaft 32 when the support shaft 35 is rotatively displaced about the rotation shaft 32 is smaller compared with the case where the distance between the rotation shaft 32 and the support shaft 35 is larger than the distance between the rotation shaft 32 and the locking portion 37*a* of the locking member 37. As a result, the displacement amount of the distance between the support shaft 35 and the locking portion 37*a* of the locking member 37 when the support shaft 35 is rotatively displaced from the receiving position to the picking-up position decreases, thereby reducing a risk of the medium holding member 38 that is hung between the support shaft 35 and the locking member 37 interfering with rotative displacement of the support shaft 35. This allows the support shaft 35 to be easily rotatable about the rotation shaft 32 during picking-up of the sheet S with the medium holding member 38 being hung between the support shaft 35 and the locking portion 37*a* of the locking member 37.

Further, in this embodiment, the rotation shaft 32 is located vertically above the straight line extending between the support shaft 35 and the locking portion 37*a* of the locking member 37 in the direction that intersects with the axial direction of the rotation shaft 32. Accordingly, when the support shaft 35 is rotatively displaced downward from the receiving position to the picking-up position during picking-up of the sheet S, the distance between the support shaft 35 and the locking portion 37*a* of the locking member 37 decreases. As a result, the support shaft 35 is rotatable about the rotation shaft 32 without effecting on the tension of the medium holding member 38 that is hung between the support shaft 35 and the locking portion 37*a* of the locking member 37.

According to the above embodiment, the following effect can be achieved:

(1) When the support shaft 35 is rotatively displaced from the receiving position to the picking-up position, the wide receiving port 50 for the sheets S in the medium receiving unit 24 is formed between the support shaft 35 and the apparatus body 13. As a result, the sheets S are easily picked-up from the medium receiving unit 24 through the wide receiving port 50. Further, in this configuration, the medium holding member 38 is hung between the support shaft 35 and the locking member 37, and accordingly, even if the support shaft 35 is rotatively displaced to widen the receiving port 50 for the sheet S, the entire receiving surface of the medium holding member 38 is prevented from being reversed since the locking member 37 is provided at a fixed position. As a result, it is possible to prevent the sheet S from extending out of the medium holding member 38 during picking-up of the sheet S.

(2) The distance between the rotation shaft 32 and the support shaft 35 in the direction that intersects with the axial direction of the rotation shaft 32 is smaller than the distance between the rotation shaft 32 and the locking portion 37*a* of the locking member 37 in the direction that intersects with the axial direction of the rotation shaft 32. Accordingly, the displacement amount of the support shaft 35 about the rotation shaft 32 when the support shaft 35 is rotatively displaced about the rotation shaft 32 is smaller compared with the case where the distance between the rotation shaft 32 and the support shaft 35 is larger than the distance between the rotation shaft 32 and the locking portion 37*a* of the locking member 37. As a result, the displacement amount of the distance between the support shaft 35 and the locking portion 37*a* of the locking member 37 when the support shaft 35 is rotatively displaced from the receiving position to the picking-up position decreases, thereby reducing a risk of the medium holding member 38 that is hung between the support shaft 35 and the locking member 37 interfering with rotative displacement of the support shaft 35. This allows the support shaft 35 to be easily rotatable about the rotation shaft 32 during picking-up of the sheet S with the medium holding member 38 being hung between the support shaft 35 and the locking portion 37*a* of the locking member 37.

(3) The rotation shaft 32 is located vertically above the straight line extending between the support shaft 35 and the locking portion 37*a* of the locking member 37 in the direction that intersects with the axial direction of the rotation shaft 32. Accordingly, when the support shaft 35 is rotatively displaced downward from the receiving position to the picking-up position during picking-up of the sheet S, the distance between the support shaft 35 and the locking portion 37*a* of the locking member 37 decreases. As a result, the support shaft 35 is rotatable about the rotation shaft 32 without effecting on the tension of the medium holding member 38 that is hung between the support shaft 35 and the locking portion 37*a* of the locking member 37.

(4) When the cam surface 45 of the groove 41 is in close contact with the engaging projection 44 due to the biasing force of the tension spring 47, the engaging projection 44 is locked by the cam surface 45 in the circumferential direction about the rotation shaft 32. As a result, the rotation position of the arm 33 about the rotation shaft 32 can be stably held. Moreover, when the support shaft 35 further rotates about the rotation shaft 32, the engaging projection 44 resists the biasing force of the tension spring 47 and moves over the cam surface 45, thereby releasing engagement between the cam surface 45 and the engaging projection 44. As a result, rotation movement of the arm 33 about the rotation shaft 32 becomes possible, thereby allowing the support shaft 35 to be displaced as necessary during picking-up of the sheet S.

Figure 8:
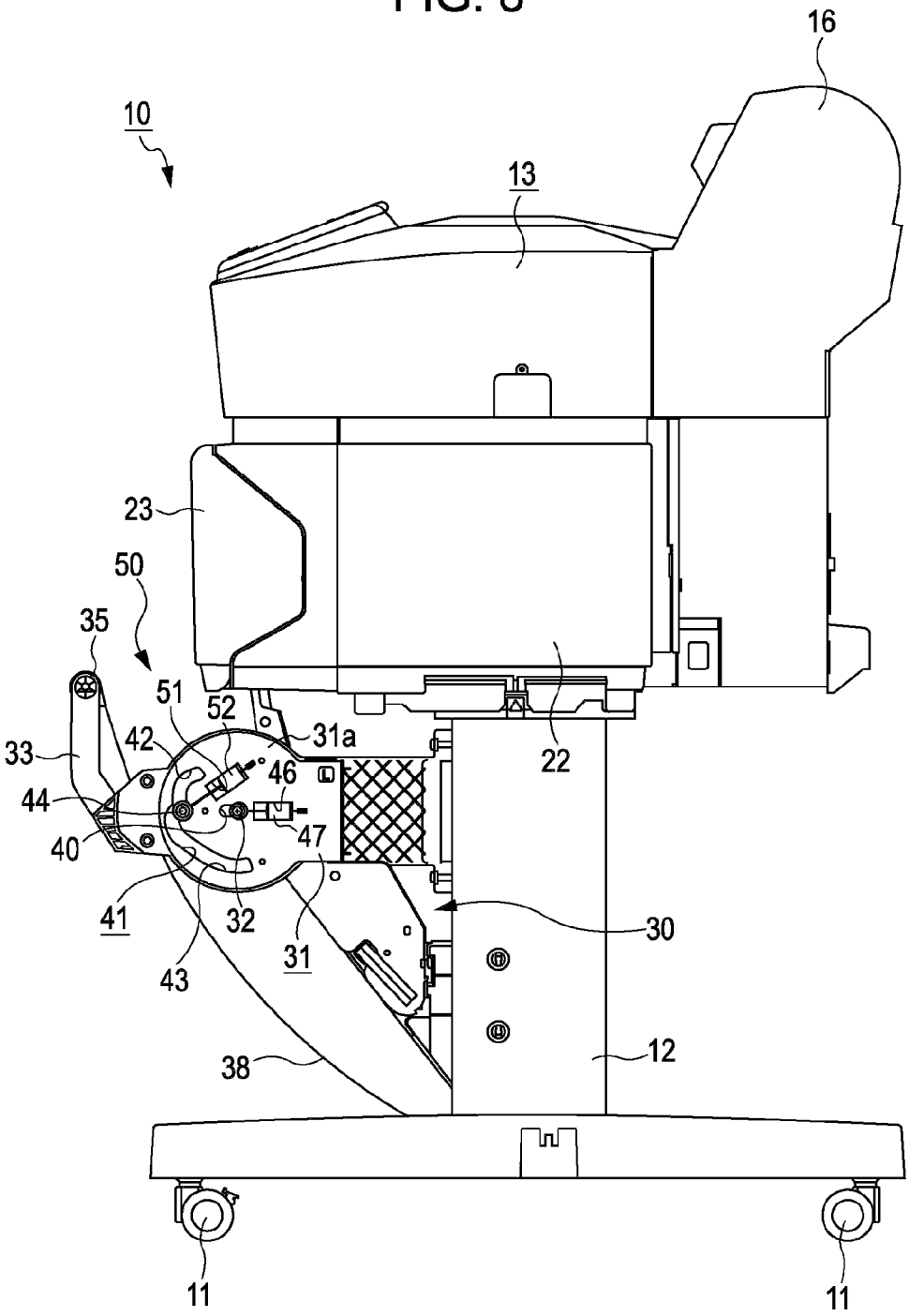
FIG. 8 is a side view of a recording device without showing a portion of an exterior of a rotative arm mechanism according to another embodiment of the invention.

The following modifications may be made to the above-mentioned embodiment:

In the above-mentioned embodiment, as shown in FIG. 8, a recess 51 may be formed vertically above the oblong hole 40 on the distal end portion 31*a* of the base 31, and a tension spring 52 may be disposed between the inner surface of the recess 51 and the engaging projection 44 of the arm 33. In this configuration, the cam surface 45 (see FIG. 9B) that locks the engaging projection 44 may be formed, for example, along the line extending between the upper end of the second groove 43 and the recess 51. In this configuration, the cam surface 45 extends straight obliquely downward from the upper end of the second groove 43 which is the lower end of the first groove 42 toward the outside in the radial direction of the rotation shaft 32.

Figure 9B:
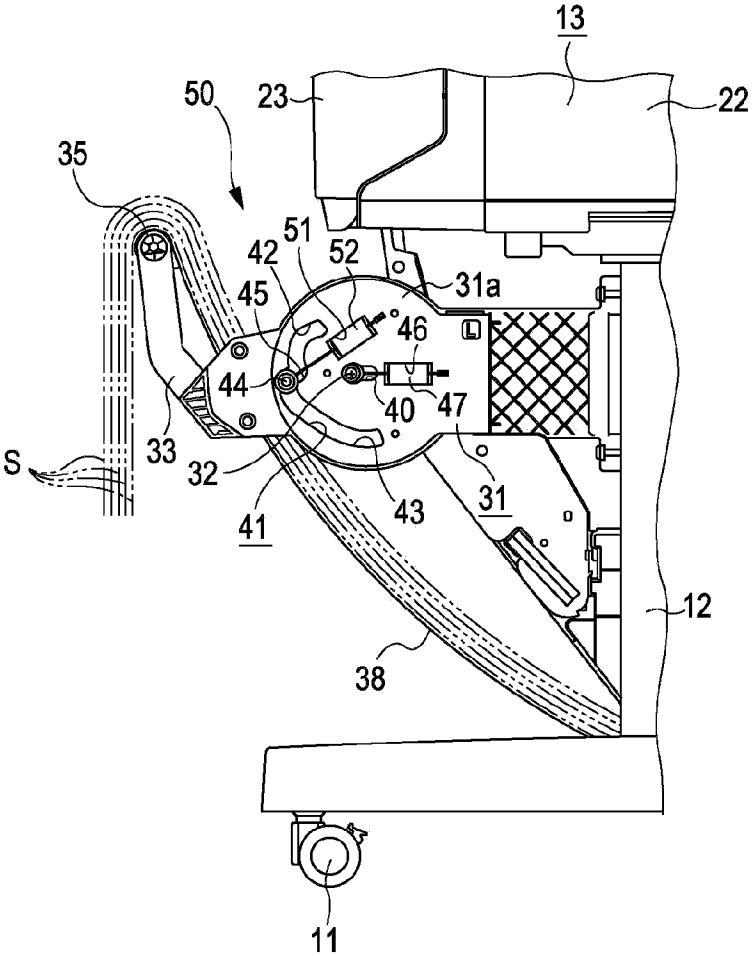
FIG. 9B is a side view of the medium receiving unit of the recording device according to the another embodiment, showing that a plurality of sheets are received in the medium receiving unit.
Figure 9A:
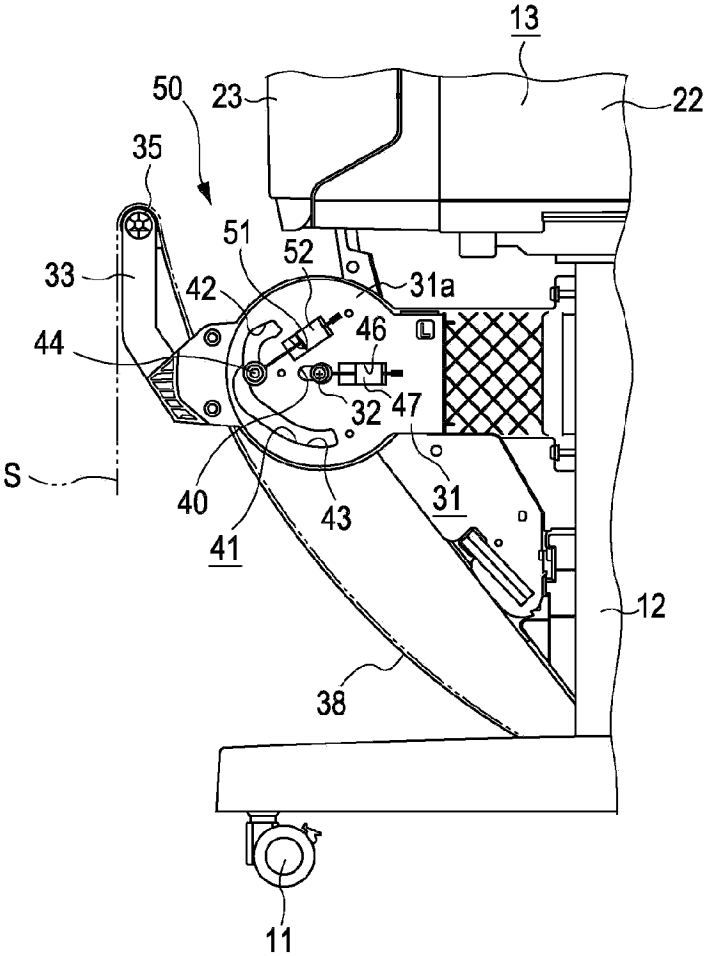
FIG. 9A is a side view of a medium receiving unit of the recording device according to the another embodiment, showing that a single sheet is received in the medium receiving unit.

In this configuration, as shown in FIG. 9A, since the tension spring 52 biases the engaging projection 44 of the arm 33 obliquely upward and backward, the engaging projection 44 of the arm 33 is brought into pressing contact with the inner surface of the upper end of the second groove 43. As a result, the engaging projection 44 is held at the upper end of the second groove 43 due to the biasing force of the tension spring 52. Accordingly, when the sheets S are held in the medium holding member 38, the rotation position of the arm 33 about the rotation shaft 32 is stably held such that the support shaft 35 is positioned at the receiving position.

When the number of the sheets S that are held in the medium holding member 38 increases, the size of the receiving port 50 for the sheet S that is formed between the apparatus body 13 and the support shaft 35 gradually decreases. In this configuration, as shown in FIG. 9B, when the weight of the sheets S increases as the number of the sheets S held in the medium holding member 38 increases, the engaging projection 44 of the arm 33 that supports the support shaft 35 slides obliquely downward on the cam surface 45 of the base 31 due to the gravity force. As a result, as the arm 33 rotates downward about the rotation shaft 32, the size of the receiving port 50 for the sheet S that is formed between the apparatus body 13 and the support shaft 35 increases. Accordingly, even if a plurality of sheets S are held in the medium holding member 38, a sufficient size of the receiving port 50 for the sheet S can be achieved between the apparatus body 13 and the support shaft 35.

Further, in this configuration, when the support shaft 35 positioned at the receiving position is lifted upward, the engaging projection 44 slides to the upper end of the first groove 42 with the aid of the biasing force of the tension spring 52. Accordingly, a load applied when the support shaft 35 is moved upward from the receiving position to the storing position while resisting the gravity force can be reduced.

Further, in this configuration, when the support shaft 35 which is positioned at the receiving position is pressed downward, the engaging projection 44 slides to the lower end of the second groove 43 while resisting the biasing force of the tension spring 52. Accordingly, when the support shaft 35 is pressed downward from the receiving position to the picking-up position, the tension spring 52 serves as a damper that buffers the downward rotative displacement of the arm 33. As a result, when the support shaft 35 moves from the receiving position to the picking-up position, it is possible to prevent sudden movement of the arm 33 in rotative displacement about the rotation shaft 32 due to a weight of the sheets S held in the medium holding member 38 or a weight of the arm 33.

Although the tension spring 52 is provided as a bias member that brings the engaging projection 44 of the arm 33 into pressing contact with the inner surface of the upper end of the second groove 43 in the example shown in FIG. 8, the bias member is not limited to the tension spring 52. For example, a torsion spring that biases the arm 33 in the circumferential direction about the rotation shaft 32 may be provided as a bias member.

In the above-mentioned embodiment, the cam surface 45 of the groove 41 may be configured to extend horizontally toward the outside in the radial direction of the rotation shaft 32, or alternatively, extend obliquely upward toward the outside in radial direction of the rotation shaft 32.

In the above-mentioned embodiment, the tension spring 47 may be configured to bring the engaging projection 44 of the arm 33 into pressing contact with the inner surface of the groove 41 by connecting one end of the tension spring 47 to the engaging projection 44 of the arm In the above-mentioned embodiment, the bias member that brings the engaging projection 44 of the arm 33 into pressing contact with the inner surface of the groove 41 is not limited to the tension spring 47, and other elastic members such as plate spring and rod spring may be used.

In the above-mentioned embodiment, the rotation shaft 32 may be located vertically below the straight line extending between the support shaft 35 and the locking portion 37*a* of the locking member 37 in the direction that intersects with the axial direction of the rotation shaft 32. Further, the rotation shaft 32 may be located on the straight line extending between the support shaft 35 and the locking portion 37*a* of the locking member 37 in the direction that intersects with the axial direction of the rotation shaft 32.

In the above-mentioned embodiment, the distance between the rotation shaft 32 and the support shaft 35 in the direction that intersects with the axial direction of the rotation shaft 32 may be larger than the distance between the rotation shaft 32 and the locking portion 37*a* of the locking member 37 in the direction that intersects with the axial direction of the rotation shaft 32. Further, the distance between the rotation shaft 32 and the support shaft 35 in the direction that intersects with the axial direction of the rotation shaft 32 may be about the same as the distance between the rotation shaft 32 and the locking portion 37*a* of the locking member 37 in the direction that intersects with the axial direction of the rotation shaft 32.

Although the recording device is embodied as a recording device 10 having the recording head 19 that ejects ink as an example of liquid in the above-mentioned embodiment, the invention may also be embodied as a liquid ejection apparatus that ejects liquid other than ink. The invention may be applied to a variety of liquid ejection apparatuses having a liquid ejection head that ejects fine liquid droplets. The liquid droplets refer to a state of liquid that is ejected from the liquid ejection apparatuses and are intended to include those in a particle, tear drop or string shape. The liquid as described herein may be any material that can be ejected from liquid ejection apparatuses. For example, it may include a material in liquid phase such as liquid having high or low viscosity, sol, gel water, other inorganic solvent, organic solvent and liquid solution, and a material in melted state such as liquid resin and liquid metal (molten metal). Further, in addition to a material in a liquid state, it may include particles of functional material made of solid substance such as pigment and metal particles, which is dissolved, dispersed or mixed in a solvent. Further, typical examples of liquid include ink as mentioned above, liquid crystal and the like. The ink as described herein includes various liquid components such as general water-based ink, oil-based ink, gel ink and hot melt ink. Specific examples of liquid ejection apparatus may include, for example, liquid ejection apparatuses that eject liquid containing materials such as electrode material and color material in a dispersed or dissolved state, which are used for manufacturing of liquid crystal displays, electro-luminescence (EL) displays, surface emitting displays or color filters. Alternatively, they may include liquid ejection apparatuses that eject bioorganic materials used for manufacturing biochips, liquid ejection apparatuses that are used as a precision pipette and eject liquid of a sample, textile printing apparatuses and micro dispensers. Further, they may also include liquid ejection apparatuses that eject lubricant to precision instrument such as a clock or camera in a pin-point manner, liquid ejection apparatuses that eject transparent resin liquid such as ultraviolet cured resin onto a substrate for manufacturing minute hemispheric lenses (optical lenses) used for optical communication elements or the like, and liquid ejection apparatuses that eject acid or alkali etching liquid for etching a substrate or the like. The invention may be applied to any one of the above-mentioned liquid ejection apparatuses.

In the above-mentioned embodiment, the medium receiving unit 24 is not necessarily provided in the recording device. For example, the invention may be applied to the medium receiving unit 24 that receives a sheet on which recording has been performed at a position lower in the gravity direction.

The entire disclosure of Japanese Patent Application No. 2012-94927, filed Apr. 18, 2012 is expressly incorporated by reference herein.

What is claimed is:

1. A medium receiving device that receives a medium which is ejected and falls from a medium ejection unit at a position lower than the medium ejection unit in a gravity direction, comprising:

a first member that extends in a width direction of the medium that intersects with an ejection direction of the medium at a position spaced from the medium ejection unit;

a second member that is fixedly provided at a position which is lower than the medium ejection unit in the gravity direction and on the side of the medium ejection unit with respect to the first member and extends in the width direction of the medium; and a medium holding member that is hung between the first member and the second member so as to form a receiving surface for the medium which falls thereon and is capable of holding the medium on the receiving surface, wherein the first member is movable between a first position which is spaced from the medium ejection unit in a direction that intersects with a vertical line and a second position which is further spaced from the medium ejection unit than the first position with rotative displacement about a rotation shaft that extends in the width direction of the medium; and wherein the rotation shaft is located vertically above a straight line extending between the first member and the second member in a direction that intersects with the axial direction of the rotation shaft.

2. A recording device comprising:

a recording unit that performs recording on a medium; and the medium receiving device according to claim 1 that receives the medium on which recording has been performed by the recording unit.

3. A medium receiving device that receives a medium which is ejected and falls from a medium ejection unit at a position lower than the medium ejection unit in a gravity direction, comprising:

a first member that extends in a width direction of the medium that intersects with an ejection direction of the medium at a position spaced from the medium ejection unit;

a second member that is fixedly provided at a position which is lower than the medium ejection unit in the gravity direction and on the side of the medium ejection unit with respect to the first member and extends in the width direction of the medium; and a medium holding member that is hung between the first member and the second member so as to form a receiving surface for the medium which falls thereon and is capable of holding the medium on the receiving surface, wherein the first member is movable between a first position which is spaced from the medium ejection unit in a direction that intersects with a vertical line and a second position which is further spaced from the medium ejection unit than the first position with rotative displacement about a rotation shaft that extends in the width direction of the medium; and wherein the medium receiving device further comprises:

a support member that is configured to be rotatable about the rotation shaft while supporting the first member and has an engaging projection that extends in the axial direction of the rotation shaft from a position spaced from the rotation shaft in a direction that intersects with the axial direction of the rotation shaft;

a member to be slid having a section to be slid on which the engaging projection slides when the support member rotates; and a bias member that biases the support member in the direction that intersects with the axial direction of the rotation shaft so that the engaging projection is brought into pressing contact with the section to be slid, wherein the section to be slid has a cam surface that locks the engaging projection in a circumferential direction about the rotation shaft due to a biasing force of the bias member.

4. The medium receiving device according to claim 3, wherein the section to be slid is composed of a first section to be slid that extends in the circumferential direction about the rotation shaft and a second section to be slid that extends downward from a lower end of the first section to be slid radially outside of the rotation shaft.

5. A recording device comprising:

a recording unit that performs recording on a medium; and the medium receiving device according to claim 3 that receives the medium on which recording has been performed by the recording unit.

6. A recording device comprising:

a recording unit that performs recording on a medium; and the medium receiving device according to claim 4 that receives the medium on which recording has been performed by the recording unit.

* * * * *